US005460025A

United States Patent [19]

Champaigne

[11] Patent Number: 5,460,025

[45] Date of Patent: Oct. 24, 1995

[54] SHOT PEENING METHOD

[75] Inventor: Jack M. Champaigne, South Bend, Ind.

[73] Assignee: Electronics Incorporated, Mishawaka, Ind.

[21] Appl. No.: 274,806

[22] Filed: Jul. 14, 1994

[51] Int. Cl.[6] ..... B24C 1/00

[52] U.S. Cl. ..... 72/53

[58] Field of Search ..... 72/53; 51/319, 51/320

[56] References Cited

U.S. PATENT DOCUMENTS 4,420,957 12/1983 Weber ..... 72/53

4,614,100 9/1986 Green et al. ..... 72/53

5,365,762 11/1994 Thompson ..... 72/53

*Primary Examiner*—David Jones

*Attorney, Agent, or Firm*—Baker & Daniels

[57] ABSTRACT

A method and apparatus for controlling a shot peening operation includes the measurement of pressures at the nozzle which directs the shot unto the workpiece and just downstream of the point where the conveying medium (generally compressed air) is communicated into the transport hose. By comparing these pressure levels with the pressures set forth in a table for a given mass rate of flow of shot through the transport hose, the peening operator can control the velocity of the shot particles applied to the workpiece, thereby controlling peening intensity.

16 Claims, 1 Drawing Sheet

SHOT PEENING METHOD

Figure 1:
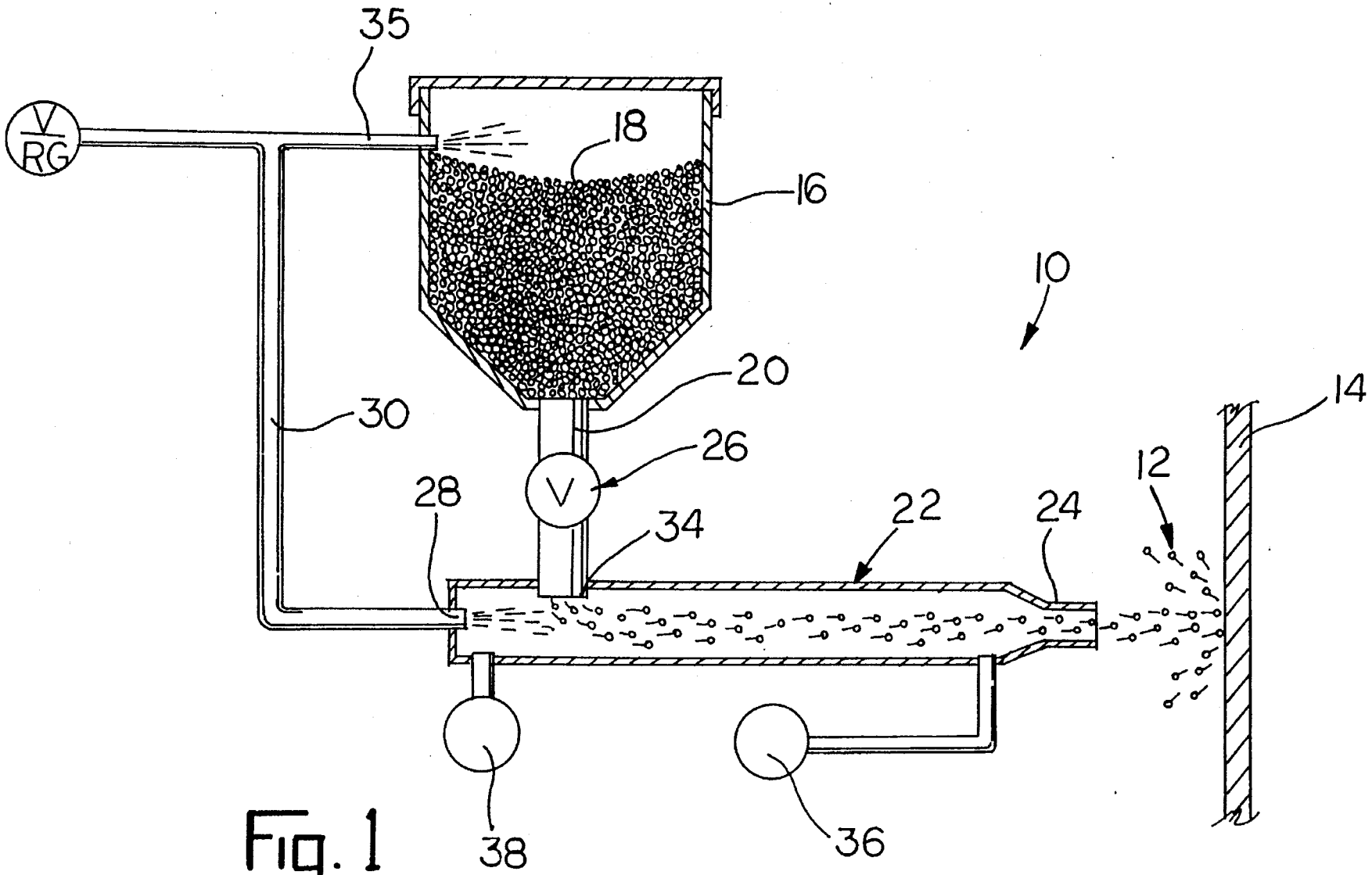

This invention relates to a method and apparatus for shot peening, and more particularly relates to the control of the velocity and kinetic energy of the shot particles.

The use of shot peening to increase the fatigue strength of material is relatively well known. A stream of shot is directed at the surface of a workpiece to cause plastic dot formation (or "dimpling") of the surface of the workpiece. Usually, the workpiece is a metal, but other materials can also be shot peened. One type of shot peening apparatus uses high pressure gas (usually air) to accelerate the shot particles, which are then directed at the workpiece through a nozzle. The size of the "dimples" placed on the workpiece by the peening operation must be carefully controlled. This is done by regulating the kinetic energy of the particles impacting the workpiece. Since kinetic energy of the particles is a function of mass of the shot particles and their velocity, and the mass of the individual particles may be easily controlled, the particle velocity is the important control parameter.

Several current methods of controlling particle velocity, and therefore intensity, of the peening process are available, but none of these prior art methods provides "real time" control of the intensity of the peening process. For example, laser technology may be used to measure particle velocity, but in order to use laser technology, the peening nozzle must be diverted to a measurement cavity, the velocity of the shot particles must then be checked, and the nozzle then returned to the peening process. Other processes for controlling peening intensity make use of the so-called "almen strip" as set forth in U.S. Pat. No. 2,350,440. In this method, a thin test strip is mounted on a fixture, a shot stream is applied to the test strip, and the deflection of the test strip is measured, thereby providing an indication of peening intensity. Sometimes these techniques are combined with a measurement of the air pressure of the stream in order to get a general indication of changes in peening intensity, but these methods lack precision, and do not provide any accurate real time, control of the peening process.

According to the present invention, a conveying hose is provided which terminates in a nozzle that directs the shot particles onto the workpiece. The conveying hose includes an inlet communicated to a regulated pressure source upstream of the conduit delivering the shot particles into the conveying hose. The conveying medium, which is usually air but may be another gas, accelerates the shot particles which are then delivered to the workpiece through a nozzle. The pressure of the air stream is measured at the air pressure inlet, and is measured again at another point at the entrance to the nozzle. By using a test cavity and the laser velocity measuring process (or any other known process for measuring particle velocity), a table may be constructing relating these two pressures with particle velocity. The only other variable in the peening process is the mass flow rate of the shot particles, which regulates the density of the "dimples" on the surface of the workpiece. Changing the mass flow rate of particles into the conveying hose will change the aforementioned pressure relationships to establish a given particle velocity. Accordingly, the aforementioned table can be made three dimensional so that for a given mass flow rate of shot particles the particle velocity can be controlled by monitoring the pressure at the inlet to the hose through which the conveying gas is communicated and the pressure at the nozzle. Accordingly, a given peening "recipe" (which specifies the shot mass flow rate and peening intensity) can be fulfilled by regulating the mass rate of flow (which may be done directly be operating a control valve), and by monitoring the upstream and downstream pressures to control particle velocity and therefore the intensity.

Furthermore, by monitoring these pressures, any anomaly in the system can be discovered as soon as it occurs and appropriate action taken. For example, a clogged nozzle will result in an increase in pressure at the entrance of the nozzle, and a worn or missing nozzle will result in a decrease of the pressure at the entrance of the nozzle. Nozzles have been known to even fall off of the conveying hose and go undetected for a significant time period. If this occurs with the use of the present invention, the pressure at the entrance of the nozzle will immediately drop, and the operator will immediately know that the anomaly has occurred. Ideally, the condition of the conveying hose and nozzle may be inspected before peening is begun by shutting off the shot flow into the conveying hose, and running a test in which compressed air at a nominal pressure is communicated through the hose and nozzle, and the upstream and downstream pressures are noted and compared with established norms. Accordingly, an indication of the condition of the hose and nozzle is available to the operator, and appropriate corrective actions can be taken before peening is initiated.

Accordingly, one advantage of the present invention is that peening intensity may be controlled during the peening operation, thus providing "real time" intensity control. Another advantage of the present invention is that the condition of the equipment may be determined before the peening operation is initiated.

These and other advantages of the present invention will become apparent from the following description, with reference to the accompanying drawings, the sole figure, FIG. 1 which is a diagram, partly in cross section, of the peening apparatus pursuant to the present invention.

Referring now to the drawings, a shot peening apparatus generally indicated by the numeral 10 directs a stream of shot particles generally indicated by the numeral 12 against the surface of a workpiece 14. The shot peening apparatus 10 includes a hopper 16 for storing the shot particles 18, a conduit 20 for conveying the shot particles 18 into a shot transport hose 22. The hose 22 terminates in a nozzle 24 for directing the stream of shot particles 12 against the surface of the workpiece 14. The mass flow rate of shot through the conduit 20 is controlled by a conventional shot flux control valve 26 which controls the mass rate of flow of shot through the conduit 20 and into the conveying hose 22.

The conveying hose 22 is provided with an inlet 28 which is communicated to a source of gas (usually air) under pressure (not shown) through conduits 30. A conventional pressure regulating valve 32 is adjustable to regulate the pressure level of the compressed gas being communicated to inlet 28. The conduit 30 includes a branch 35 which communicates the pressure regulating valve 32 with the hopper 16, such that the shot 18 in the hopper is pressurized to the same pressure level communicated to the inlet 28. As can be seen from the drawings, the conduit 20 conveys shot particles 18 into the conveying hose 22 at a connection point generally indicated by the numeral 34, which is between the inlet 28 and the nozzle 24. A pressure measuring device 36 measures the pressure level in the conveying hose 22 at the entrance of the nozzle 24, and a pressure measuring device 38 measures the pressure within the conveying hose 22 just downstream of the inlet 28.

As discussed above, the control parameters used in shot peening operations are the shot mass flow rate or flux, and the velocity of the individual shot particles. The shot flux determines how quickly the surface being treated will be impacted. If the flux is too low for a given exposure time, some of the surface of the workpiece will remain untreated after the exposure is over. Conversely, if the shot flux is too large, excessive surface impaction may result in surface damage and increases susceptibility to fatigue failure. The shot velocity establishes the amount of energy delivered with each impact, which controls the surface profile and depth of the compressed layer. Shot kinetic energy is commonly termed shot intensity, and is a function of the mass of the individual shot particle and the particle velocity.

According to the present invention, a given particle velocity at a given shot flow rate or flux will always result in the same readings of pressure sensed by measuring device 36 at the end of the entrance of the nozzle and pressure sensed by measuring device 38 at the inlet 28. Accordingly, at a given shot mass flow rate, a given particle velocity can be established by maintaining the pressure readings of devices 36 and 38. The system is initially calibrated by using one of the prior art methods, such as laser techniques, to measure the velocity of the shot particles as the pressure regulating valve 32 is varied to create varying transport pressures within the transporting hose 22. The pressures sensed by devices 36 and 38 for a measured particle velocity are recorded, thereby constructing a table which, for a given shot flow rate into to the transport hose 22, relates the pressures sensed by devices 36, 38 to particle velocity. The tables may be made three dimensional as a function of varying flow rates as set by the valve 26. Accordingly, the shot peening operator can follow a "recipe" of a shot flow rate and intensity, and then look up in the table to determine the pressures sensed by devices 36, 38 that will yield the desired particle velocity at the specified mass flow rate. Accordingly, during the peening operation, the pressures as measured by devices 36 and 38 are continually monitored to assure that they remain substantially the same as those set forth in the recipe table.

If the pressure measuring device 36 indicates the pressure at the entrance to the nozzle 24 increases, a clogged nozzle is indicated, which will thereby reduce the nozzle velocity. The operator accordingly knows that the nozzle needs to be cleaned, so peening is discontinued while the corrective action is taken. On the other hand, if the pressure measured by measurement device 36 abruptly decreases, a worn or missing nozzle is indicated. Occasionally, in the past, nozzle 24 has fallen off the transporting hose 22 and has not been noticed by the operator, which of course, means that workpiece 14 is not correctly peened. If the pressure measuring devices 36 and 38 are monitored and an abrupt decrease in pressure is noted at the pressure measuring device 36, the operator is immediately aware that corrective action must be taken, such as replacing the worn or missing nozzle.

Another factor which may affect the readings at 36 and 38 is a change in the mass rate of flow of shot through the connection 34. This may occur because the hopper 16 has run out of shot, or because the valve 26 has not been set properly or has become defective. In any event, the operator will immediately be aware that the velocity of the particles is not correct, and can terminate peening so that no parts will be improperly peened. The only other factor which can affect the pressure readings at 36 and 38 is an increase or decrease in pressure at the pressure source as regulated by the adjustable regulating valve 32. Again, when such changes at the pressure source result in variations of pressure at the inlet 28, the operator will immediately be aware of the fact that the shot velocity is no longer correct, and can investigate and take the proper remedial action.

Ideally, before the peening operation begins, the operator makes a calibration run by turning off the flow valve control value 26 to prevent the shot particles 18 from being conveyed into the transporting hose 22 and adjust the valve 32 to provide a pressure at measuring device 28 representing a nominal operating value of a pressure used in the peening operation. The pressures at devices 36 and 38 are then read, and compared to a table of pressures for the nominal value of pressure as set by regulating valve 32. While normally it is desirable for the transport hose 22 to be as short as possible, it may be necessary to increase the length of the hose 22 (and even to coil the hose) so that the hose 22 is long enough that a meaningful, measurable pressure drop will occur between devices 38 and 36.

If the pressure at 36, 38 are reasonably close to the pressure levels set forth in the table, the operator knows that the hose and nozzle are in good condition and that the peening process can proceed. Accordingly, the flux control valve 26 is set at the desired shot mass flow rate required by the peening "recipe" and the regulating valve 32 is then adjusted until the pressure measuring devices 36, 38 are established at the pressures set forth for the desired velocity in the table. Since the calibration run has been made and the hose and nozzle have been established as being in proper operating condition, the valve 32 may be set at a level providing the pressures at 36 and 38 as set forth in the table for the desired velocity. Accordingly, any change in the pressure measured by devices 36 and 38 will immediately alert the operator that peening should be discontinued and the source of the problem identified and corrected. The peening operation may then continue.

As pointed out above, the prior art intensity control methods did not provide "real time" control of the peening operation. While pressures were measured at points in the system, the only way to determine particle velocity was to use the aforementioned almen strip, or by measuring particle velocity by the aforementioned laser or other particle velocity measurement techniques. However, none of these methods assure that changes have not taken place during peening that affect peening intensity; according, there can be no assurance that peening at the proper intensity has occurred. With the method and apparatus of the present invention, it is immediately apparent to the peening operator that anomaly has occurred, and appropriate corrective action can be taken. Accordingly, proper peening of all of the workpieces 14 is assured.

I claim:

1. Shot peening method comprising the steps of conveying shot into a transport hose at a predetermined mass flow rate, supplying gas under pressure to said hose through an inlet opening for accelerating said shot, discharging said shot from said hose through a nozzle directed at a workpiece being treated, determining from a look up table the pressure levels in said hose at a first measuring point at said nozzle and at a second measuring point upstream from said first measuring point required to establish a desired shot velocity at said predetermined shot mass flow rate, controlling the pressure of said gas supplied to said hose to establish said pressure levels at said first and second measuring points representing said desired shot velocity of shot being conveyed through said hose, monitoring the pressure levels at said first and second measuring points during treatment of the workpiece, and discontinuing treatment of said workpiece when a change of either of said pressure levels indicates a velocity of the particles being transported through said hose that is other than the desired velocity.

2. Shot peening method as claimed in claim 1, wherein said shot is conveyed into said transport hose through a conduit connected into the hose at a connection point between said first and second measuring points.

3. Shot peening method as claimed in claim 2, wherein said second measuring point is between said inlet opening and said connection point.

4. Shot peening method as claimed in claim 1, wherein said method includes the step of inspecting said transport hose and nozzle before treatment of said workpiece is initiated without disassembly of the transport hose and nozzle.

5. Shot peening method as claimed in claim 1, wherein said method includes the step of inspecting the transport hose and nozzle before treatment of the work piece is initiated supplying compressed gas to said transport hose through said inlet without conveying shot into said transport hose, and comparing the pressure levels at said first and second measuring points with predetermined norms indicative of a hose and nozzle in satisfactory condition.

6. Shot peening method as claimed in claim 1, wherein said first measuring point is at the entrance to said nozzle.

7. Shot peening method comprising the steps of conveying shot into a transport hose at a predetermined mass flow rate, supplying gas under pressure to said hose through an inlet opening for accelerating said shot, discharging said shot from said hose through a nozzle directed at a workpiece being treated, measuring the pressure levels in said hose at a first measuring point at said nozzle and at a second measuring point upstream from said first measuring point, controlling the pressure of said gas supplied to said hose to establish predetermined pressure levels at said first and second measuring points representing a desired velocity of shot being conveyed through said hose, discontinuing treatment of said workpiece when a change of either of said pressure levels indicates a velocity of the particles being transported through said hose that is other than the desired velocity, and inspecting the transport hose and nozzle before treatment of the work piece is initiated by supplying compressed gas to said transport hose through said inlet without conveying shot into said transport hose, and comparing the pressure levels at said first and second measuring points with predetermined norms indicative of a hose and nozzle in satisfactory condition.

8. Shot peening method as claimed in claim 7, wherein said shot is conveyed into said transport hose through a conduit connected into the hose at a connection point between said first and second measuring points.

9. Shot peening method as claimed in claim 8, wherein said second measuring point is between said inlet opening and said connection point.

10. Shot peening method as claimed in claim 7, wherein said first measuring point is at the entrance to said nozzle.

11. Shot peening method comprising the steps of conveying shot into a transport hose at a predetermined mass flow rate, supplying gas under pressure to said hose through an inlet opening for accelerating said shot, discharging said shot from said hose through a nozzle directed at a workpiece being treated, generating a table relating values of shot velocities for given values of shot flow rates to the pressure levels in said hose at a first measuring point at said nozzle and at a second measuring point upstream from said first measuring point, determining from said table the pressure levels in said hose at said first measuring point and at said second measuring point required to establish a desired shot velocity at said predetermined shot mass flow rate, controlling the pressure of said gas supplied to said hose to establish said pressure levels at said first and second measuring points representing said desired shot velocity of shot being conveyed through said hose, monitoring the pressure levels at said first and second measuring points during treatment of the workpiece, and discontinuing treatment of said workpiece when a change of either of said pressure levels indicates a velocity of the particles being transported through said hose that is other than the desired velocity.

12. Shot peening method as claimed in claim 11, wherein said shot is conveyed into said transport hose through a conduit connected into the hose at a connection point between said first and second measuring points.

13. Shot peening method as claimed in claim 12, wherein said second measuring point is between said inlet opening and said connection point.

14. Shot peening method as claimed in claim 11, wherein said method includes the step of inspecting said transport hose and nozzle before treatment of said workpiece is initiated without disassembly of the transport hose and nozzle.

15. Shot peening method as claimed in claim 11, wherein said method includes the step of inspecting the transport hose and nozzle before treatment of the work piece is initiated by supplying compressed gas to said transport hose through said inlet without conveying shot into said transport hose, and comparing the pressure levels at said first and second measuring points with predetermined norms indicative of a hose and nozzle in satisfactory condition.

16. Shot peening method as claimed in claim 11, wherein said first measuring point is at the entrance to said nozzle.

* * * * *